US011078835B2

(12) United States Patent
Bigot et al.

(10) Patent No.: US 11,078,835 B2
(45) Date of Patent: Aug. 3, 2021

(54) BEARING GUIDE DEVICE OF A COMBUSTION PISTON FOR A VARIABLE COMPRESSION RATIO ENGINE

(71) Applicants: MCE 5 Development, Lyons (FR); Vianney Rabhi, Lyons (FR)

(72) Inventors: Sylvain Bigot, Pau (FR); Maxence Pister, Saint-Maurice-de-Beynost (FR)

(73) Assignees: MCE 5 Development, Villeurbanne (FR); Vianney Rabhi, Lyons (FR)

( * ) Notice: Subject to any disclaimer, the term of this patent is extended or adjusted under 35 U.S.C. 154(b) by 239 days.

(21) Appl. No.: 16/303,289

(22) PCT Filed: May 16, 2017

(86) PCT No.: PCT/FR2017/051175

§ 371 (c)(1),
(2) Date: Nov. 20, 2018

(87) PCT Pub. No.: WO2017/203127

PCT Pub. Date: Nov. 30, 2017

(65) Prior Publication Data

US 2020/0318534 A1 Oct. 8, 2020

(30) Foreign Application Priority Data

May 24, 2016 (FR) ..... 1654648

(51) Int. Cl.
*F02B 75/04* (2006.01)
*F02D 15/02* (2006.01)

(52) U.S. Cl.
CPC ..... *F02B 75/04* (2013.01); *F02D 15/02* (2013.01)

(58) Field of Classification Search
CPC ..... F02B 75/04; F02D 15/02
See application file for complete search history.

(56) References Cited

U.S. PATENT DOCUMENTS 6,601,551 B1 8/2003 Rabhi
7,441,530 B2 * 10/2008 Tinker ..... F02B 75/32 123/197.1

(Continued)

FOREIGN PATENT DOCUMENTS

FR 2763097 B1 9/1999
FR 3027051 B1 11/2016

OTHER PUBLICATIONS

International Written Opinion for International Application No. PCT/FR2017/051175 dated Sep. 4, 2017, 5 pages.

(Continued)

*Primary Examiner* — Kevin A Lathers
(74) *Attorney, Agent, or Firm* — TraskBritt

(57) ABSTRACT

A bearing guide device of a combustion piston for a variable compression ratio engine. The movement of the combustion piston from a top dead center to a bottom dead center drives the movement of a synchronized roller made up of a cylindrical body and a pinion from a first position to a second position relative to first and second racks. According to the disclosure, the first and/or second racks have a different circular pitch than the pinion so that the flanks of the teeth of the pinion engage with the flanks of the teeth of the first and second racks only when the pinion is in the first or second position.

11 Claims, 8 Drawing Sheets

(56) References Cited

U.S. PATENT DOCUMENTS

| | | | | |
|---|---|---|---|---|
| 2004/0168669 | A1* | 9/2004 | Rabhi | F02B 75/045 123/197.3 |
| 2009/0266337 | A1 | 10/2009 | Rabhi | |
| 2010/0107746 | A1* | 5/2010 | Rabhi | F02B 77/08 73/114.16 |
| 2011/0048382 | A1* | 3/2011 | Pattakos | F02B 75/045 123/48 B |
| 2016/0305471 | A1* | 10/2016 | Wittek | F16C 23/10 |

OTHER PUBLICATIONS

International Search Report for International Application No. PCT/FR2017/051175 dated Sep. 4, 2017, 2 pages.

* cited by examiner

BEARING GUIDE DEVICE OF A COMBUSTION PISTON FOR A VARIABLE COMPRESSION RATIO ENGINE

CROSS-REFERENCE TO RELATED APPLICATIONS

This application is a national phase entry under 35 U.S.C. § 371 of International Patent Application PCT/FR2017/051175, filed May 16, 2017, designating the United States of America and published as International Patent Publication WO 2017/203127 A1 on Nov. 30, 2017, which claims the benefit under Article 8 of the Patent Cooperation Treaty to French Patent Application Serial No. 1654648, filed May 24, 2016.

TECHNICAL FIELD

The disclosure relates to a bearing guide device of a combustion piston for a variable compression ratio engine.

BACKGROUND

As shown in FIGS. 1 and 2, a known transmission device 1 of a variable compression ratio engine comprises a toothed wheel 5 associated with an assembly made up of a connecting rod 6 and a crankshaft 9.

The toothed wheel 5, whose teeth are large in size, interacts on one side with a control device 7 and on the other with a transmission assembly or transmission unit 3. For this purpose, the transmission unit 3 and the control device 7 are equipped with a rack for receiving the large-sized teeth of the toothed wheel 5.

The transmission unit 3 forms one piece with a combustion piston 2, guided and driven in translational motion in a main direction in a cylinder 10. The toothed wheel 5 transmits the movement between the crankshaft 9 and the combustion piston 2.

The control device 7 is secured to a control device (not shown in the figures, but described, for example, in the application FR9804601). This device makes it possible to adjust the position, along the main direction, of the control device 7 in the engine block. It, therefore, makes it possible to adjust the top dead center and the bottom dead center of the combustion piston 2, thus making the compression ratio of the engine variable and controllable.

To ensure the translational motion of the combustion piston 2 in the cylinder 10, the transmission device also comprises a bearing guide device 4.

This bearing guide device 4 comprises a synchronization plate 41, forming one piece with the engine block, and consisting of a first rolling track or raceway 48, and a first rack 46, in two parts disposed on either side of the first rolling track or raceway 48 as shown in FIGS. 1 and 2.

The bearing guide device 4 also comprises a second rack 37 and a second rolling track or raceway 38, arranged on the transmission unit 3, on the side opposite the rack interacting with the large-sized teeth of the toothed wheel 5.

Finally, the bearing guide device 4 comprises a synchronized roller 40 consisting of a cylindrical body 42 and a pinion 44, integral with each other without any degree of freedom. The synchronized roller 40 may be made up of a single part. In the example shown in FIGS. 1 and 2, the pinion 44 is formed of two parts disposed on either side of the cylindrical body 42.

The cylindrical body 42 of the synchronized roller 40, placed between the synchronization plate 41 and the transmission unit 3, is in contact with the second and first rolling tracks or raceways 38, 48. The teeth of the pinion 44 are, in turn, received by the second and first racks 37, 46.

In operating condition, the movement of the combustion piston 2 from its top dead center to its bottom dead center in the cylinder 10 causes the synchronized roller 40 to move by rolling on the first rolling track or raceway 48 of the synchronization plate 41 and on the second rolling track or raceway 38 of the transmission unit 3, against which it is maintained.

Specifically, the pinion 44 moves from a first position, corresponding to the top dead center of the combustion piston 2, vis-à-vis the first and second racks 46, 37, to a second position corresponding to the bottom dead center of the combustion piston 2. FIGS. 3*a* and 3*b* show a view of the bearing guide device 4 in the first and second positions, respectively.

The bearing guide device 4 guides the transmission unit 3 and the combustion piston 2 by blocking and releasing certain directions of movement. For this purpose, the synchronized roller 40, the synchronization plate 41 and the transmission unit 3 may be provided with grooves and/or ribs (such as the rib 49 of the synchronization plate 41, and the groove 43 of the synchronized roller 40 shown in FIG. 2) engaging in each other to only allow translational motion, along the main direction, of the control unit and the combustion piston 2.

The bearing guide device 4 also synchronizes the movement of the synchronized roller 40 along the main direction. To achieve this, the diameter of the cylindrical body 42 is chosen such that it corresponds to the pitch diameter of the pinion 44. The second and first racks 37, 46 are also designed so that they have the same module (which reflects the pitch (e.g., circular pitch) of the teeth) that the pinion 44 has. This ensures the proper meshing of the pinion 44 and the second and first racks 37, 46, and the rolling without the slip of the cylindrical body 42 on the first and second rolling tracks or raceways 48, 38 of the synchronization plate 41 and the transmission unit 3. In other words, the adhesive movement of the cylindrical body 42 on the first and second rolling tracks or raceways 48, 38 is coordinated with the obstacle movement of the teething of the pinion 44 on the second and first racks 37, 46.

Finally, the function of the bearing guide device 4 is to take over the transversal loads (that is, along a direction perpendicular to the axis of linear motion of the combustion piston 2 and perpendicular to the axis of the crankshaft 9), which are likely to develop in the transmission device 1 when the engine is running.

In this respect, reference can be made to documents EP1740810, EP1979591 and FR3027051, which present various solutions leading to the application of static or dynamic forces on the transmission device 1 and, in particular, on the bearing guide device 4, so as to ensure the contact of between the moving components of the transmission device 1 themselves and against the engine block.

It is sometimes observed, in the known bearing guide device 4 that has just been described, premature wear out of the teeth constituting the pinion 44 and the second and first racks 37, 46, or even their mechanical damage, which is not desirable.

BRIEF SUMMARY

The aim of the present disclosure is to provide a bearing guide device remedying this disadvantage at least in part.

In order to achieve one of these aims, the purpose of the present disclosure is to propose a bearing guide device for a combustion piston for a variable compression ratio engine. The device comprises a synchronized roller made up of a cylindrical body and a pinion, the cylindrical body having an effective diameter that can vary as a result of a radial load when the engine is running. The synchronized roller interacts:

- On the one hand, with a synchronization plate, forming one piece with the engine block, comprising a first raceway for receiving the cylindrical body and a first rack for receiving the pinion; and
- On the other hand, with a transmission unit forming one piece with the combustion piston, comprising a second raceway for receiving the cylindrical body and a second rack for receiving the pinion.

The movement of the combustion piston from a top dead center to a bottom dead center causes the pinion to move from a first position to a second position relative to the first and second racks.

According to the disclosure, the first and/or second racks have a different circular pitch from the circular pitch of the pinion so that the flanks of the teeth of the pinion engage with the flanks of the teeth of the first and second racks only when the pinion is in the first or second position.

Thus, according to the disclosure, the circular pitch of at least one of the second and first racks 37, 46 is chosen so that the pinion 44 progresses in this rack by rolling and without any contact that may create premature wear out or mechanical deterioration of the teething.

According to other advantageous and non-exhaustive characteristics of the disclosure, considered individually or along with any technically feasible combination:

- The effective diameter of the cylindrical body is constantly smaller or constantly greater than the pitch diameter of the pinion when the engine is running;
- The effective diameter of the cylindrical body is constantly smaller than the pitch diameter of the pinion when the engine is running; and the first and/or second rack has a smaller circular pitch than the circular pitch of the pinion; alternatively:
  - The circular pitch of the first rack is smaller than the circular pitch of the pinion; the circular pitch of the second rack is equal to the circular pitch of the pinion and the gap between two teeth of the second rack is bigger than the thickness of a tooth;
  - The first rack and the second rack have a circular pitch that is smaller than the circular pitch of the pinion;
- The effective diameter of the cylindrical body is constantly greater than the pitch diameter of the pinion when the engine is running; and the first and/or second rack has a bigger circular pitch than the circular pitch of the pinion; alternatively:
  - The circular pitch of the second rack is bigger than the circular pitch of the pinion; the circular pitch of the first rack is equal to the circular pitch of the pinion; and the width of the gullet of the teeth of the first rack is much bigger than the thickness of a tooth;
  - The first rack and the second rack each have a circular pitch that is bigger than the circular pitch of the pinion;
- The cylindrical body has a curved profile.

BRIEF DESCRIPTION OF THE DRAWINGS

Other features and advantages of the disclosure will emerge from the detailed description of the disclosure, which follows with reference to the accompanying drawings in which.

DETAILED DESCRIPTION

To simplify the forthcoming description, the same references are used for identical elements or performing the same function in the different forms of embodiment of the disclosure or according to the state of the art.

Preliminary Remarks

By investigating the origin of the premature wear out of certain elements of the bearing guide device 4 of the state of the art that has just been presented, the inventors of this application have made the following remarks.

Figure 4:
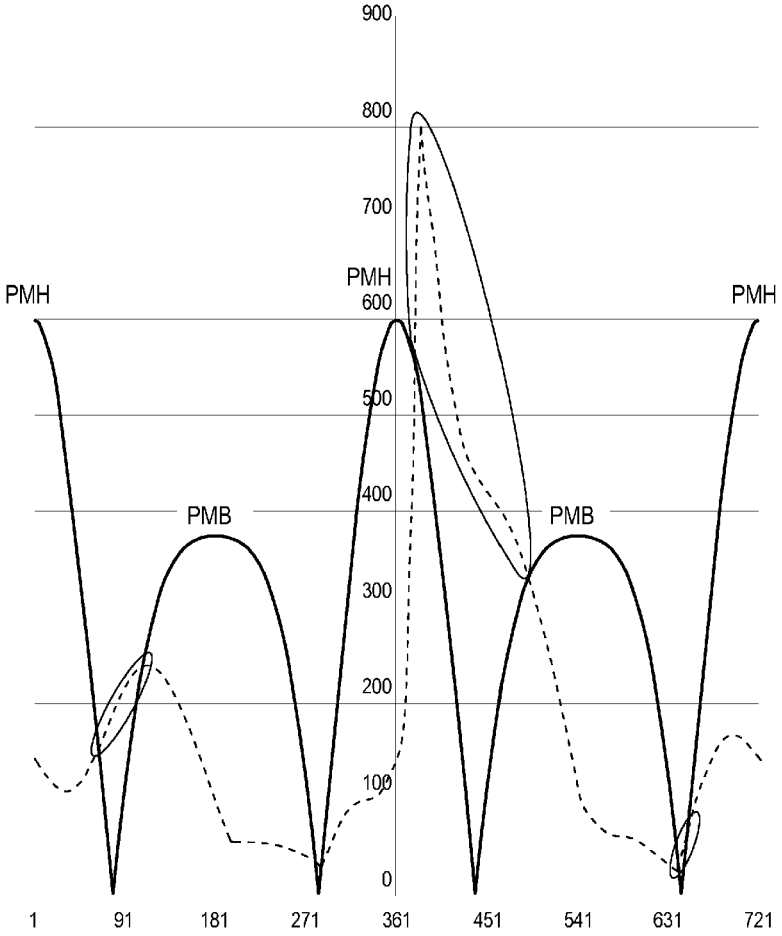
FIG. 4 shows the intensity of the forces of inertia and friction applied to the synchronized roller during an engine cycle.

FIG. 4 shows, in solid lines, the intensity of the forces of inertia applied to the synchronized roller 40 during an engine cycle. The x-axis corresponds to the angular position of the crankshaft (in degrees) and the y-axis, the intensity of the forces of inertia (in Newton). It should be noted that the forces have four maximums at about 90° from each other, corresponding to the passages to the top dead center and to the bottom dead center of the combustion piston 2. These maximums of the force of inertia are respectively denoted PMH and PMB on FIG. 4. They correspond to the changes in direction of the rotational and translational motion of the synchronized roller 40.

Figure 1:
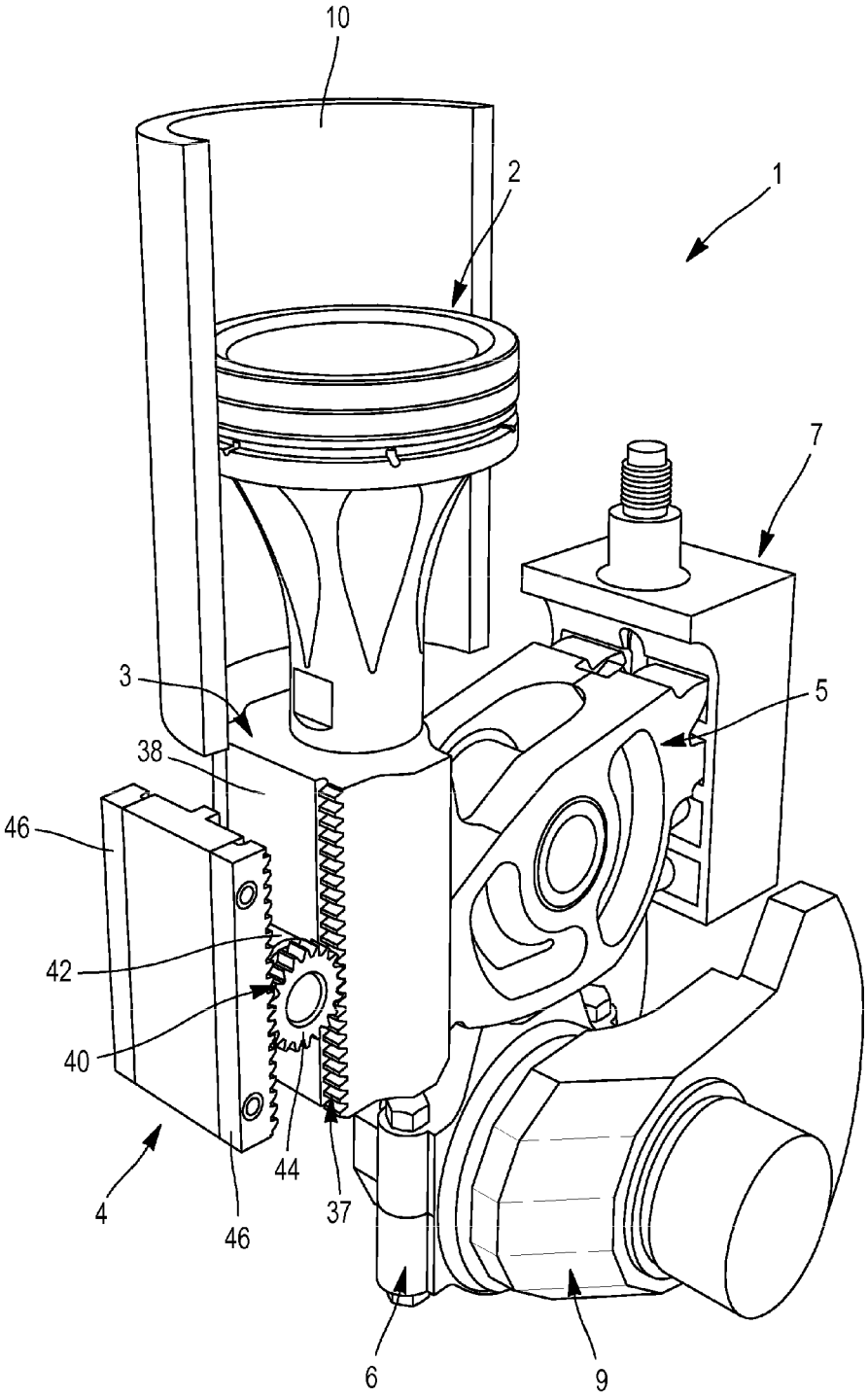
FIG. 1 PRIOR ART
FIGS. 1 and 2 show two views of a transmission device of a variable compression ratio engine according to the state of the art.
Figure 2:
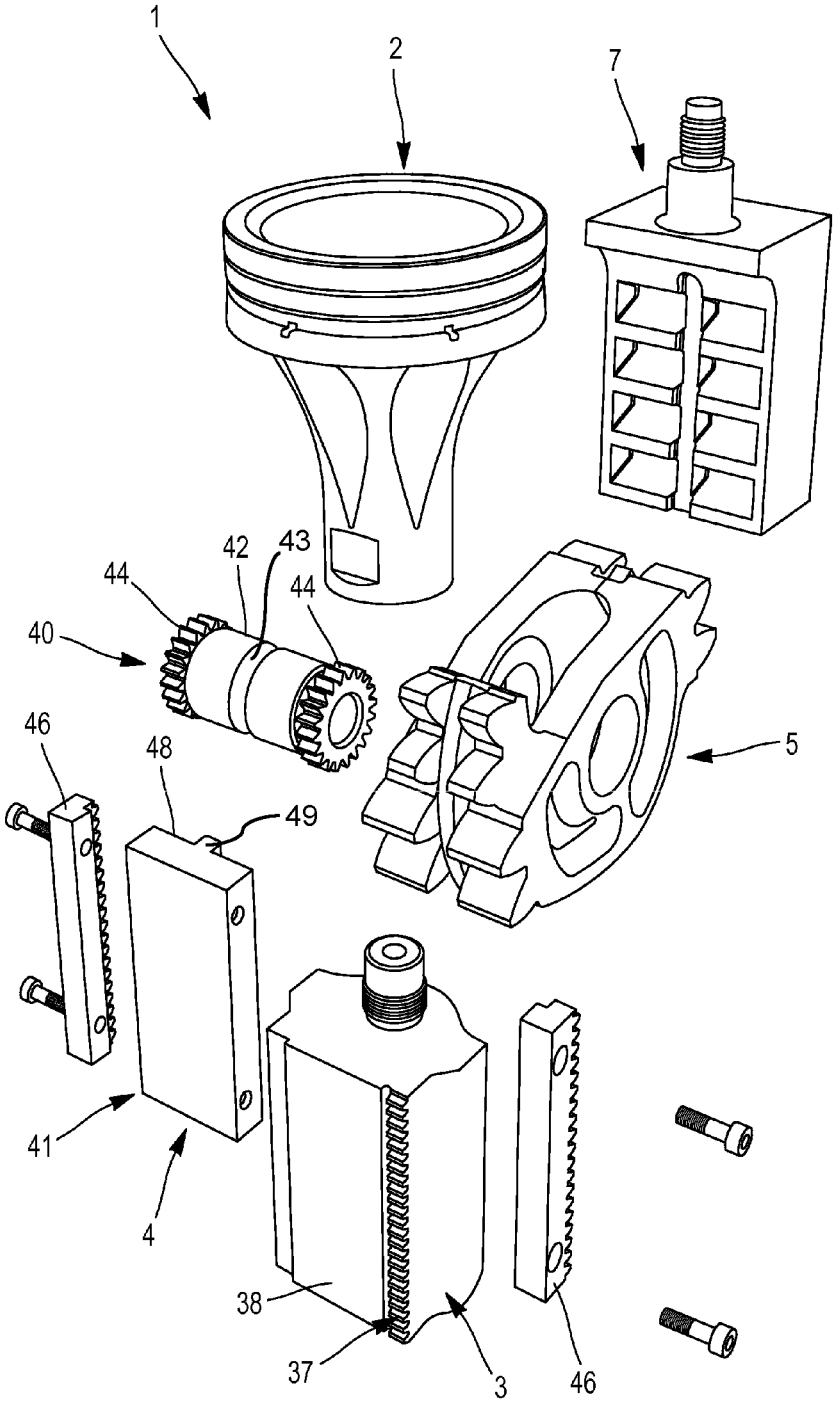
FIG. 2 PRIOR ART
Figure 3A:
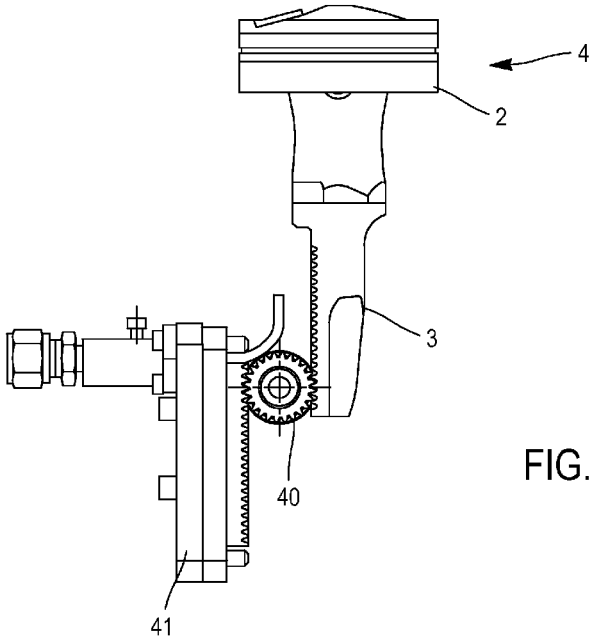
FIGS. 3*a* and 3*b* show a view of the guide device in a first and a second position, respectively.
Figure 5A:
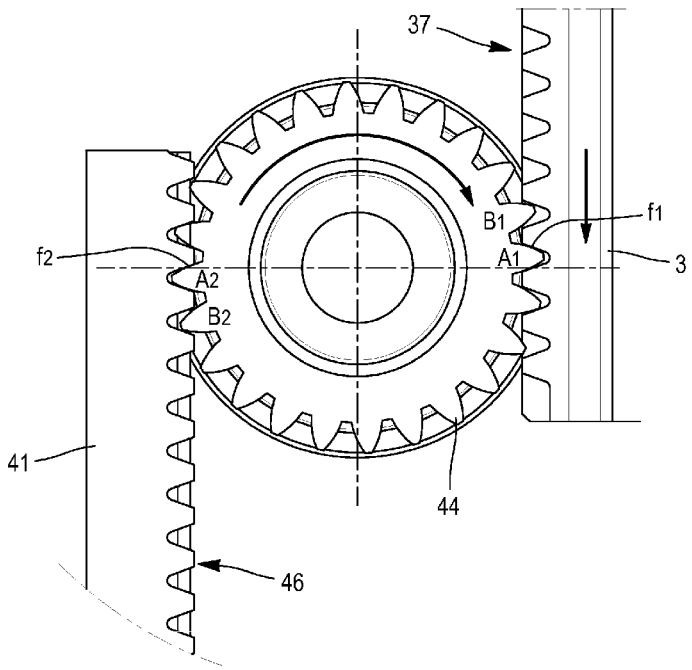
FIG. 5*a* shows the meshing of the pinion on the first and second racks, in its first position when the diameter of the cylindrical body is precisely equal to the pitch diameter of the pinion.

In a guide device according to the state of the art, FIG. 5*a* shows the meshing of the pinion 44 on the first and second racks 46, 37 of the synchronization plate 41 and of the transmission unit 3, in its first position (corresponding to the position of top dead center of the combustion piston 2 of FIG. 3*a*). The diameter of the cylindrical body 42 is precisely equal to the pitch diameter of the pinion 44. This pinion 44, the first and second racks 46, 37 each have a circular pitch (e.g., pitch, module, modulus) of 1 and 24 teeth. As is customary, provision has also been made for sufficient clearance, in the teeth of the pinion 44, of the first and second racks 46, 37, to allow the meshing to operate efficiently. An arrow on the pinion 44 and on the transmission unit 3 indicates the direction of motion of these elements just after reaching the top dead center shown in the figure. A1 and B1 have also been noted as the first pair of teeth of the pinion 44, which is meshed or about to mesh with the second rack 37 of transmission unit 3.

A2 and B2 have been noted as a second pair of teeth of the pinion 44 meshed, or about to mesh, with the first rack 46 of the synchronization plate 41.

The considerable forces of inertia that are applied, at the top dead center, on the synchronized roller 40 have led to placing the synchronized roller 40 in the first position with respect to the racks, as shown in FIG. 5*a*.

Note, that in this first position, the flank denoted f1 in FIG. 5*a* of the tooth A1 of the pinion 44 meshed in the second rack 37 of the transmission unit 3 is in extended contact with the sidewall of a tooth of this second rack 37. It should also be noted that this flank f1 is an inner flank to the pair of teeth (A1, B1), that is, the flank f1 of the meshed tooth A1 faces the tooth B1, which is about to mesh.

On the side of the synchronization plate 41, it is observed that the flank f2 of the meshed tooth A2 is in extended contact with the flank of a tooth of the first rack 46. This flank f2 is an external flank to the pair of teeth (A2, B2), that is, the flank f2 of the meshed tooth A2 is not face to face with a flank of tooth B2, which is about to mesh.

It should, therefore, be observed that in the first position of synchronized roller 40, there is a contact dissymmetry, both on the side of the synchronization plate 41 and the side of the transmission assembly or transmission unit 3.

Figure 5B:
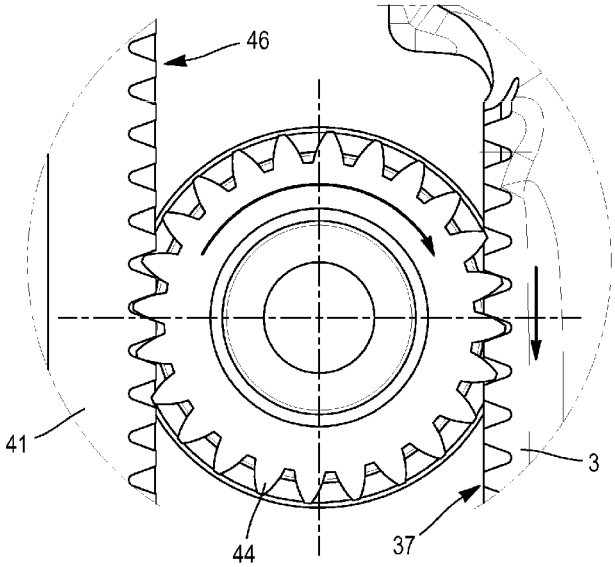
FIG. 5*b* shows the meshing of the pinion on the first and second racks, in its second position when the diameter of the cylindrical body is precisely equal to the pitch diameter of the pinion.

FIG. 5*b* shows, for the same bearing guide device 4 as that shown in FIG. 5*a*, the meshing of the pinion 44 in its second position (corresponding to the bottom dead center position of the combustion piston 2). In this representation, the diameter of the cylindrical body 42 is precisely equal to the pitch diameter of the pinion 44. In FIG. 5*b*, the movement of moving parts is indicated by arrows just before reaching the second position shown. The perfect meshing of the teeth of the pinion 44 in the teeth of the first rack 46 and in the teeth of the second rack 37 is observed.

In the representations of FIGS. 5*a* and 5*b*, the cylindrical body 42 of the synchronized roller 40 has a design diameter that corresponds precisely to the pitch diameter of the pinion 44. It was observed, however, that the effective diameter of the cylindrical body 42 generally did not fit this design diameter. On the one hand, inaccuracies or manufacturing tolerances do not make it possible to produce a cylindrical body 42 having a diameter precisely equal to the design diameter. On the other hand, the transversal loads that are applied to the transmission device 1 and to the bearing guide device 4 when the engine is running, deform the cylindrical body 42 by crushing. These two phenomena contribute to establish a cylindrical body 42 whose effective diameter is different from its design diameter and, therefore, the pitch diameter of the pinion 44.

It should be noted at this stage of the description that the transversal loads capable of deforming the cylindrical body 42 are variable when the engine is running. They originate from the forces applied to the transmission device 1 by a pressure mechanism to prevent or limit the transverse movements of the transmission device 1 (as recalled in the introduction of this application), and the bearing forces of the connecting rod 6 on the crankshaft 9. The cylindrical body 42 is, therefore, likely to be deformed and have a variable effective diameter over time, as a result of these loads.

This variance between the effective diameter of the cylindrical body 42 and the pitch diameter of the pinion 44 seeks to desynchronize the bearing of the pinion 44 in the first and second racks 46, 37 of the movement of the cylindrical body 42 on the first and second rolling tracks or raceways 48, 38. However, this desynchronization is not possible because the synchronized roller 40 is made up of a single part, or parts integral with each other. In order to preserve the integrity of this part or prevent its disengagement, it is imperative for the cylindrical body 42 to be able to slip on the first and second rolling tracks or raceways 48, 38. This slip can be a slip in linear motion of the main axis when the diameter of the cylindrical body 42 is smaller than the pitch diameter of the pinion 44; or in axis rotation of the cylinder if the effective diameter of the cylindrical body 42 is greater than the pitch diameter.

To allow this slip, it is necessary for the teeth of the pinion 44 to produce a slipping force that, when combined with the forces of inertia that are applied to the synchronized roller 40, is greater than the frictional forces of the cylindrical body 42 on the first and second rolling tracks or raceways 48, 38.

These frictional forces that oppose the forces of inertia and the possible slipping forces are essentially proportional, in intensity, to the transversal loads that are variably exerted on the bearing guide device 4. The intensity of the frictional forces is related to the intensity of the transversal loads via a coefficient of friction. FIG. 4 shows, in dotted lines, the intensity of the typical frictional forces that is applied during an engine cycle.

It should be noted that at the angular positions corresponding to the top dead centers and bottom dead centers, the frictional forces have a lower intensity than the forces of inertia that is applied to the roller.

As a result, the cylindrical body 42 is free to slide, especially so that the synchronized roller 40 occupies the first and second positions, flank-to-flank, which have been presented in relation to FIGS. 5*a* and 5*b*.

Figure 3B:
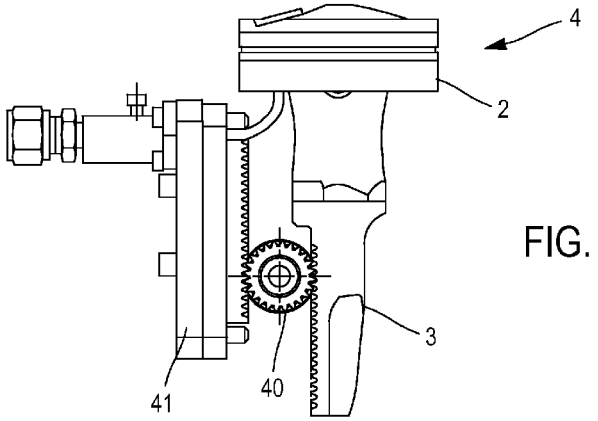

It should also be observed that in certain other angular positions, encircled in FIGS. 3*a* and 3*b*, the intensity of the frictional forces is greater than the intensity of the forces of inertia. This does not enable the slipping of the cylindrical body 42 without the teeth of the pinion 44 providing the additional efforts required.

In these phases where slipping is not naturally possible, the meshing of the teeth of the pinion 44 of the first and second racks 46, 37 is no longer perfectly coordinated. The edge or top of a tooth can then come into forced contact with the protruding or receding flank of an opposing tooth. This phenomenon is at the origin of the premature wear out observed. It is shown in more detail in FIG. 5*c*.

Figure 5C:
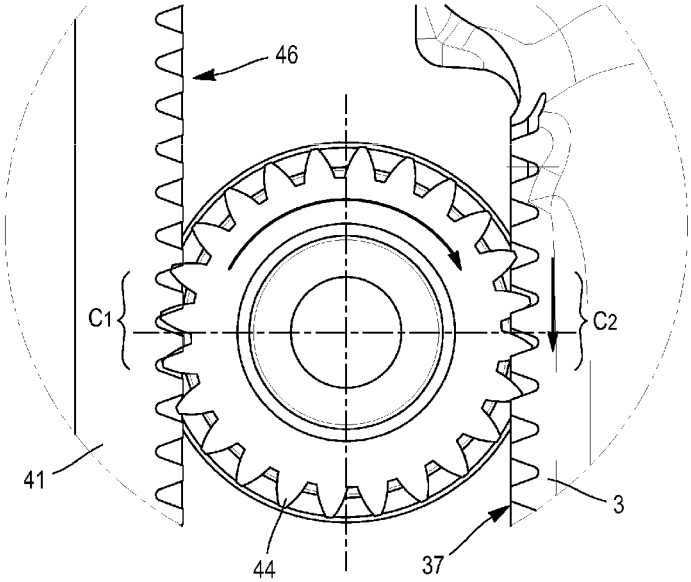
FIG. 5*c* shows the meshing of the pinion on the first and second racks, in its second position when the diameter of the cylindrical body is precisely smaller than the pitch diameter of the pinion, and when the circular pitch of the racks are identical to the circular pitch of the pinion.

FIG. 5*c* corresponds to a similar configuration to that of FIG. 5*b*, and represents the bearing guide device 4 when the combustion piston 2 has moved from the top dead center position of FIG. 5*a* to the bottom dead center. However, in the representation of FIG. 5*c*, the diameter of the cylindrical body 42 is smaller than the pitch diameter of the pinion 44. Then, the imperfection of the meshing that ensues can be noticed, especially as an incoherence at the level of the contact areas marked C1 and C2 in FIG. 5*c*. These areas of contact between the edges, the tops or flanks of the teeth lead to the aforementioned effect of wear out mechanism.

Similar observations could be made in the case where the effective diameter of the cylindrical body 42 is greater than the pitch diameter of the pinion 44.

Improved Guide Device

The inventors of this application have relied on the fine observations that have just been made to provide an improved bearing guide device 4 that can help reduce the effect of wear out mechanism.

The principle of the disclosure consists in configuring the bearing guide device 4 so as to favor the rolling motion of the cylindrical body 42 on the first and second rolling tracks or raceways 48, 38 and, thus, prevent it from slipping.

For this purpose, the circular pitch of the second rack 37 of the transmission unit 3 and/or the first rack 46 of the synchronization plate 41 is adjusted to ensure that outside of the first and second positions, there is no forced contact between the flanks and the tops or edges of the teeth of the meshing. In other words, the circular pitch of at least one of the second and first racks 37, 46 is chosen so that the pinion 44 progresses in this rack by rolling and without any contact that may create premature wear out or mechanical deterioration of the teething. The flanks of the teeth of the pinion 44 then only bear against the flanks of the teeth of the first and/or second racks 46, 37 when the pinion 44 occupies the first or second position.

This choice of design leads to the formation of at least one of the first and second racks 46, 37 so that it should have a different circular pitch from that of the pinion 44.

The measures to be taken to obtain such a non-contact bearing result that can create accelerated wear out must be different based on whether the cylindrical body 42 has an effective diameter that is greater or smaller than the pitch diameter of the pinion 44.

As a result, the cylindrical body 42 is designed to have a constantly smaller or constantly greater effective diameter, during engine operation, than the pitch diameter of the pinion 44. Knowing the maximum manufacturing tolerances and transversal loads that can be applied to the bearing guide device 4 (from which the maximum deformation of the cylindrical body 42 can be deduced), it is possible to determine the design diameter of the cylindrical body 42, which guarantees compliance with this requirement.

Thus, and according to a first approach, the diameter of the cylindrical body 42 is chosen so that its effective diameter is constantly smaller than that of the pitch diameter of the pinion 44 when the engine is running.

In this case, the first rack 46 of the synchronization plate 41 has a smaller circular pitch than the circular pitch of the pinion 44. This circular pitch is chosen so that in the first and second positions (respectively at the top dead center and bottom dead center), a "flank-to-flank" configuration of the meshed teeth in the first rack 46 is obtained. This ensures that between the first and second positions, there is no forced contact on the flanks of the teeth, other than those required for bearing the pinion 44.

In this case also, and in order to further limit the effects of wear out mechanism, one can choose to adapt the circular pitch of the second rack 37 placed on the transmission unit 3 by decreasing or alternatively to increase the clearance of its teeth, that is, to ensure that the width of the gullet of the teeth of the second rack 37 is significantly greater than the width of the pinion tooth. In other words, the gap between two teeth of this second rack 37 is bigger than the thickness of a pinion tooth.

Either of these configurations ensures the bearing of the pinion 44 in the second rack 37 without bringing the sides, the edges or the tops of the teeth into contact with each other.

It should be noted that since the contact between the second rack 37 and the pinion 44 is on the inner flanks of the meshing, it is possible to indifferently adapt the circular pitch or the operating clearance of the second rack 37 to obtain these results.

Figure 6A:
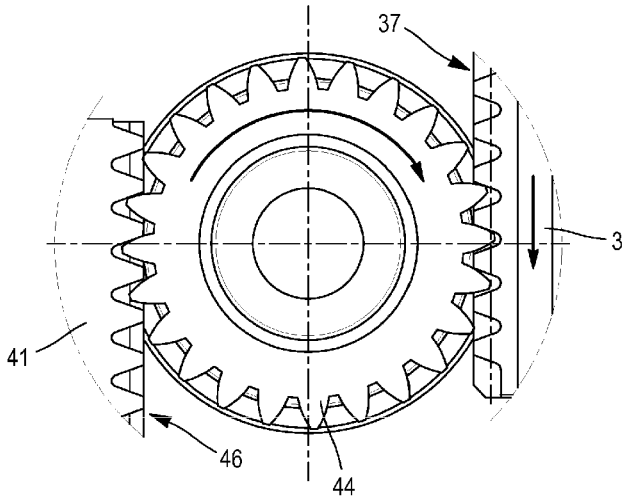
FIGS. 6*a*, 6*b* and 6*c* show the meshing of the pinion with the first and second racks when the circular pitch of the rack of the synchronization plate is smaller than the circular pitch of the pinion and when the clearance of the rack of the control unit is enlarged.
Figure 6B:
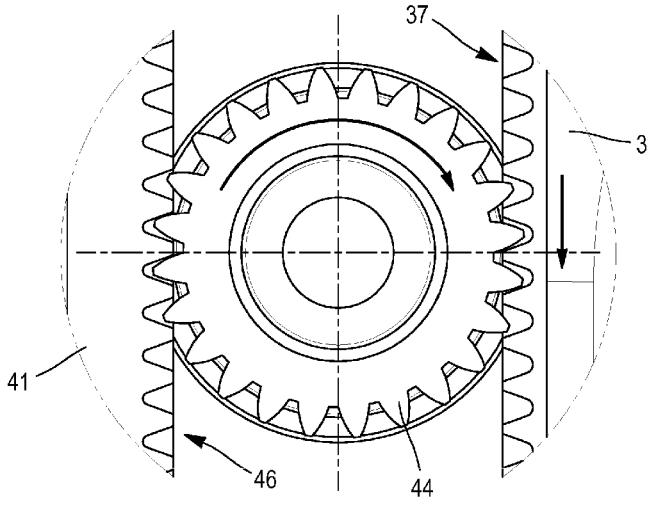
Figure 6C:
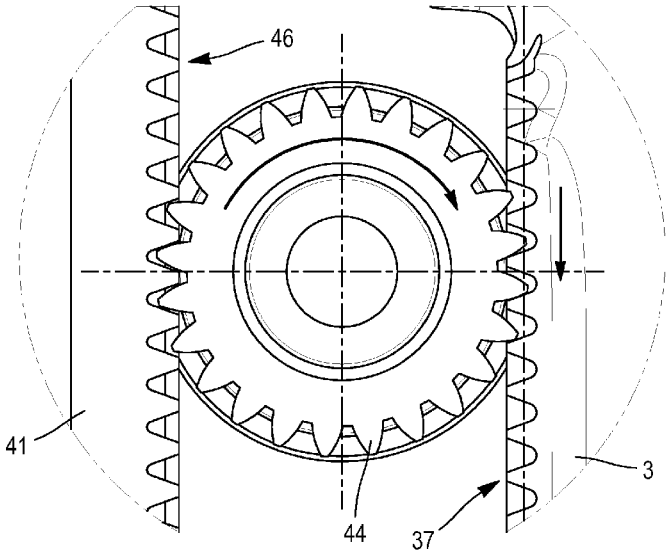

Thus, FIGS. 6*a* to 6*c* show such a configuration, consistent with the disclosure, according to which the diameter of the cylindrical body 42 has been chosen to be always smaller than the pitch diameter of the pinion 44. Moreover, the circular pitch of the first rack 46 of the synchronization plate 41 has been chosen to be smaller than that of the pinion 44, and the backlash of the second rack 37 of the transmission unit 3 has been increased.

In FIG. 6*a*, the pinion 44 is in the first position corresponding to the top dead center position of the combustion piston 2. The arrows on the moving parts indicate the movement thereof, just after passing through this point.

In FIG. 6*b*, the pinion 44 is halfway between the top dead center position and the bottom dead center position of the combustion piston 2.

In FIG. 6*c*, the pinion 44 is in the second position corresponding to the bottom dead center of the combustion piston 2. The arrows on the moving parts indicate the movement thereof, just before passing through this point.

The meshing inconsistencies are neither observed in the first position of the pinion 44 of FIG. 6*a*, nor in the second position of the pinion 44 of FIG. 6*c*, nor in the intermediate position of FIG. 6*b*. On the contrary, it should be observed that the adjustments made at the first and second racks 46, 37 make it possible to ensure the "flank-to-flank" arrangements of the meshed teeth in these two positions.

According to a second approach, the diameter of the cylindrical body 42 is chosen so that its effective diameter is constantly greater than that of the pitch diameter of the pinion 44 when the engine is running.

In this case, the second rack 37 placed on the transmission unit 3 has a bigger circular pitch than that of the pinion 44. This ensures that there is no forced contact on the flanks of the teeth, other than those required for bearing the pinion 44.

In this second approach, one can choose to adapt the circular pitch of the first rack 46 of the synchronization plate 41 or alternatively to increase its clearance. So, this ensures the bearing of the pinion 44 in the rack without bringing the sides, the edges or the tops of the teeth into contact with each other.

In a variant that may be applied indifferently to either of the approaches that have just been presented, the cylindrical body 42 has a convex shape. This shape is advantageous in that it provides a better rolling contact with the first and second rolling tracks or raceways 48, 38, especially in the presence of a load, which has the effect of crushing the convex shape and putting the surfaces in straight-line contact with one another.

This effect will be taken into account when determining the design diameter of the cylindrical body 42, so that, depending on the chosen approach, the effective diameter is constantly lower or higher than the pitch diameter of the pinion 44 when the engine is running.

Of course, the disclosure is not limited to the embodiments described and variations may be made without departing from the scope of the disclosure as defined by the claims.

The invention claimed is:

1. A bearing guide device of a combustion piston for a variable compression ratio engine, the device comprising:

a synchronized roller comprising a cylindrical body and a pinion, the cylindrical body having an effective diameter that can vary as a result of a radial load when the engine is running, the synchronized roller cooperating with:

a synchronization plate forming one piece with the engine block and comprising a first raceway for receiving the cylindrical body and a first rack for receiving the pinion; and a transmission unit forming one piece with the combustion piston and comprising a second raceway for receiving the cylindrical body and a second rack for receiving the pinion;

wherein moving the combustion piston from a top dead center to a bottom dead center causes the pinion to move from a first position to a second position in relation to the first and second racks, wherein the first rack and/or the second rack has a different circular pitch from the circular pitch of the pinion so that flanks of teeth of the pinion engage on the flanks of the teeth of the first rack and/or second rack only when the pinion is in the first or second position, thus outside of the first and the second positions there is no forced contact between the flanks of the teeth of the pinion and the flanks of the teeth of the first and/or second racks.

2. The bearing guide device of claim 1, wherein the effective diameter of the cylindrical body is always smaller or always greater than the pitch diameter of the pinion when the engine is running.

3. The bearing guide device of claim 2, wherein the effective diameter of the cylindrical body is always smaller than the pitch diameter of the pinion when the engine is running, and the first rack and/or the second rack has a smaller circular pitch than the circular pitch of the pinion.

4. The bearing guide device of claim 3, wherein the first rack has a smaller circular pitch than the circular pitch of the pinion, the second rack has a circular pitch that is equal to the circular pitch of the pinion, and a gap between two teeth of the second rack is bigger than a thickness of a pinion tooth.

5. The bearing guide device of claim 3, wherein the first rack and the second rack have a circular pitch that is smaller than the circular pitch of the pinion.

6. The bearing guide device of claim 2, wherein the effective diameter of the cylindrical body is always larger than the pitch diameter of the pinion when the engine is running, and the first rack and/or the second rack has a bigger circular pitch than the circular pitch of the pinion.

7. The bearing guide device of claim 6, wherein the second rack has a bigger circular pitch than the circular pitch of the pinion, wherein the first rack has a circular pitch that is equal to the circular pitch of the pinion, and wherein a width of the gullet of the teeth of the first rack is bigger than a thickness of a tooth.

8. The bearing guide device of claim 6, wherein the first rack and the second rack have a circular pitch that is bigger than the circular pitch of the pinion.

9. The bearing guide device of claim 1, wherein the cylindrical body has a curved profile.

10. The bearing guide device of claim 1, wherein the effective diameter of the cylindrical body is always smaller than the pitch diameter of the pinion when the engine is running, and the first rack and/or the second rack has a smaller circular pitch than the circular pitch of the pinion.

11. The bearing guide device of claim 1, wherein the effective diameter of the cylindrical body is always larger than the pitch diameter of the pinion when the engine is running and wherein the first rack and/or the second rack has a bigger circular pitch than the circular pitch of the pinion.

* * * * *